US008416145B2

(12) United States Patent
Shih et al.

(10) Patent No.: US 8,416,145 B2
(45) Date of Patent: Apr. 9, 2013

(54) MULTI-BAND PRINTED ANTENNA

(75) Inventors: Han-Jung Shih, Tainan (TW); Chao-Hua Lu, Zhubei (TW)

(73) Assignee: Realtek Semiconductor Corp., Hsinchu (TW)

( * ) Notice: Subject to any disclaimer, the term of this patent is extended or adjusted under 35 U.S.C. 154(b) by 402 days.

(21) Appl. No.: 12/657,080

(22) Filed: Jan. 13, 2010

(65) Prior Publication Data

US 2010/0177004 A1 Jul. 15, 2010

(30) Foreign Application Priority Data

Jan. 13, 2009 (TW) ..... 98101102 A

(51) Int. Cl.
*H01Q 11/00* (2006.01)

(52) U.S. Cl.
USPC ..... 343/843

(58) Field of Classification Search ..... 343/834, 343/817, 810, 818, 833, 835, 843
See application file for complete search history.

(56) References Cited

U.S. PATENT DOCUMENTS

| | | | | |
|---|---|---|---|---|
| 6,380,905 | B1 | 4/2002 | Annamaa et al. | |
| 7,352,326 | B2 | 4/2008 | Korva et al. | |
| 7,589,678 | B2 | 9/2009 | Perunka et al. | |
| 8,115,686 | B2 | 2/2012 | Mumbru et al. | |
| 2005/0195124 | A1 * | 9/2005 | Puente Baliarda et al. | 343/893 |
| 2005/0259013 | A1 * | 11/2005 | Gala Gala et al. | 343/702 |
| 2006/0244665 | A1 | 11/2006 | Tung | |
| 2007/0108198 | A1 * | 5/2007 | Richardson et al. | 219/734 |
| 2007/0247373 | A1 * | 10/2007 | Egorov | 343/702 |
| 2008/0198082 | A1 * | 8/2008 | Soler Castany et al. | 343/770 |
| 2009/0174612 | A1 * | 7/2009 | Ayala et al. | 343/702 |
| 2009/0231228 | A1 * | 9/2009 | Qi et al. | 343/804 |
| 2009/0243943 | A1 * | 10/2009 | Mumbru et al. | 343/702 |
| 2009/0262028 | A1 * | 10/2009 | Mumbru et al. | 343/702 |
| 2010/0013732 | A1 * | 1/2010 | Kapuliansky et al. | 343/866 |
| 2010/0149064 | A1 * | 6/2010 | Gala et al. | 343/848 |
| 2011/0260926 | A1 * | 10/2011 | Illera et al. | 343/700 MS |

FOREIGN PATENT DOCUMENTS

CN 1431734 7/2003

OTHER PUBLICATIONS

"The Compact Quad-band PCB embedded Antenna for Mobil handsets" by Gyubok Park, Soonho Hwang, Joonho Byun, and Austin S. Kim; Telecommunication R&D Center, Samsun Electronics Co., LTD.; E-mail: gyubok.park@samsung.com; 978-1-4222-2042-1/08/ $25.00 2008 IEEE.

* cited by examiner

*Primary Examiner* — Huedung Mancuso
(74) *Attorney, Agent, or Firm* — McClure, Qualey & Rodack, LLP

(57) ABSTRACT

The present invention discloses a multi-band printed antenna, comprising: a grounding plane; and an antenna part, including a shorted arm electrically connected to the grounding plane, a folded arm connected to the shorted arm, and a feeding arm connected to the folded arm, feeding arm being for providing signals to the folded arm and shorted arm; wherein the folded arm includes at least one turning corner and provides at least two resonant frequencies according to the turning corner and the total length of the folded arm.

10 Claims, 5 Drawing Sheets

MULTI-BAND PRINTED ANTENNA

BACKGROUND OF THE INVENTION

1. Field of Invention

The present invention relates to a multi-band printed antenna.

2. Description of Related Art

Conventionally, a printed antenna is merely functional at a single frequency, but not applicable to a multi-band communication system such as WLAN 802.11a/b/g which operates at more than one frequency.

Therefore, the invention provides a multi-band printed antenna, particularly a multi-band printed antenna with a coupling effect.

SUMMARY OF THE INVENTION

An objective of the present invention is to provide a multi-band printed antenna.

In order to achieve the foregoing and other objectives, according to one perspective of the present invention, it provides a multi-band printed antenna comprising: a grounding plane; and an antenna part, including a shorted arm electrically connected to the grounding plane, a folded arm connected to the shorted arm, and a feeding arm connected to the folded arm, the feeding arm being for providing signals to the folded arm and the shorted arm; wherein the folded arm includes at least one turning corner and provides at least two resonant frequencies according to the turning corner and the total length of the folded arm.

In the aforementioned multi-band printed antenna, in one embodiment, a portion of the folded arm and a portion of the shorted arm form a coupling structure such that the length of the folded arm can be shortened by the coupling effect. The coupling structure may be a structure having one or more coupling gaps, or a Meander type coupling structure.

In the aforementioned multi-band printed antenna, the folded arm includes at least one chamfer structure.

In the aforementioned multi-band printed antenna, preferably, the portion of the folded arm forming the coupling structure has a first width, and another portion of the folded arm has a second width, the first width being greater than the second width.

In the aforementioned multi-band printed antenna, the folded arm may include a plurality of segments, in which at least one segment includes a portion having an increasing width.

The objectives, technical details, features, and effects of the present invention will be better understood with regard to the detailed description of the embodiments below.

DESCRIPTION OF THE PREFERRED EMBODIMENTS

The drawings as referred to throughout the description of the present invention are for illustration only, but not drawn according to actual scale.

Figure 1A:
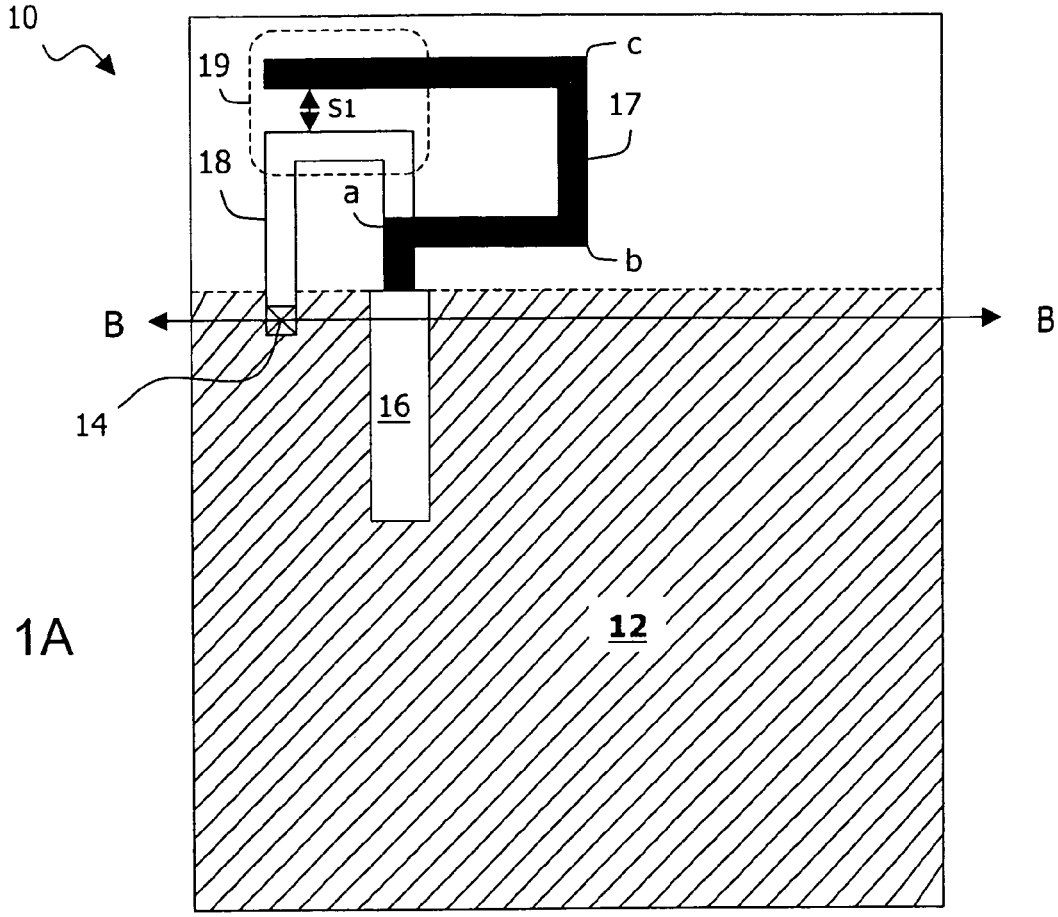
FIG. 1A is a schematic diagram of a first embodiment according to the present invention.
Figure 1B:
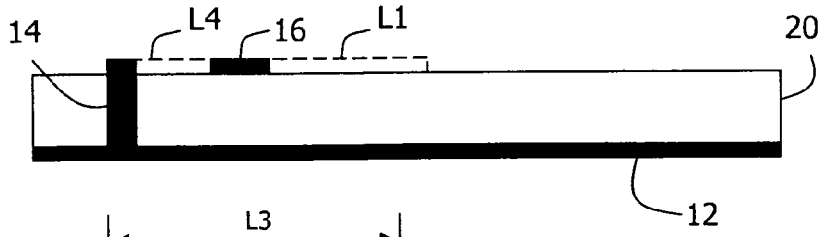
FIG. 1B shows a schematic cross-sectional diagram taken along the cross sectional line B-B in FIG. 1A.
Figure 2:
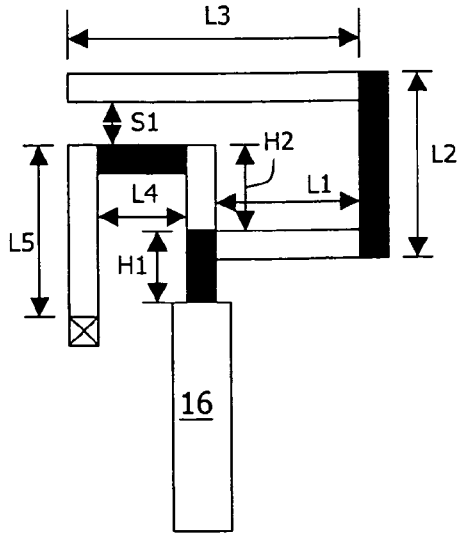
FIG. 2 shows the relationship between a folded arm and a frequency band in the first embodiment.

FIG. 1A and FIG. 1B show the first embodiment of the present invention. FIG. 1A is a top view of the embodiment, and FIG. 1B is a cross-sectional diagram taken along the line B-B in FIG. 1A. As shown in FIG. 1 and FIG. 2, a multi-band printed antenna 10 comprises a grounding plane 12 beneath a substrate 20, and an antenna part above the substrate 20. The two parts are electrically connected to each other by, e.g., a shorting pin 14. The antenna part comprises a feeding arm 16, a folded arm (the dark part) 17, and a shorted arm (the white part) 18. In the embodiment of the present invention, a portion of the folded arm 17 and a portion of the shorted arm 18 form a coupling structure 19 with a coupling gap S1. The shorting pin 14 electrically connects the grounding plane 12 with one end of the shorted arm 18. The function of the feeding arm 16 is for transmitting signals to the folded arm 17 and the shorted arm 18.

Referring to FIG. 2, the folded arm 17 can be considered as a combination of four segments H1, L1, L2, and L3, with three turning corners (a, b, and c in FIG. 1, i.e., joints of H1 and L1, L1 and L2, and L2 and L3, respectively). The shorted arm 18 can be considered as a combination of three segments H2, L4, and L5. The total length of the folded arm 17 is H1+L1+L2+L3, which determines, with compensation by the coupling effect of the coupling gap S1, the lower resonant frequency of the antenna. The length H1+L1 of the folded arm 17 determines the higher resonant frequency of the antenna. Assuming a first wave length $\lambda_1$ the wave length in correspondence to the higher resonant frequency, and a second wave length $\lambda_2$ the wave length in correspondence to the lower resonant frequency, the length H1+L1 approximates $\lambda_1/4$ (possibly with small difference which may require fine-tune). The total length H1+L1+L2+L3 is less than $\lambda_2/4$ due to the coupling effect. In other words, the coupling effect induced by the segments L3 and L4 decreases the required total length of the folded arm 17, such that a lower resonant frequency can be generated within a relatively smaller area of the antenna.

Figure 3:
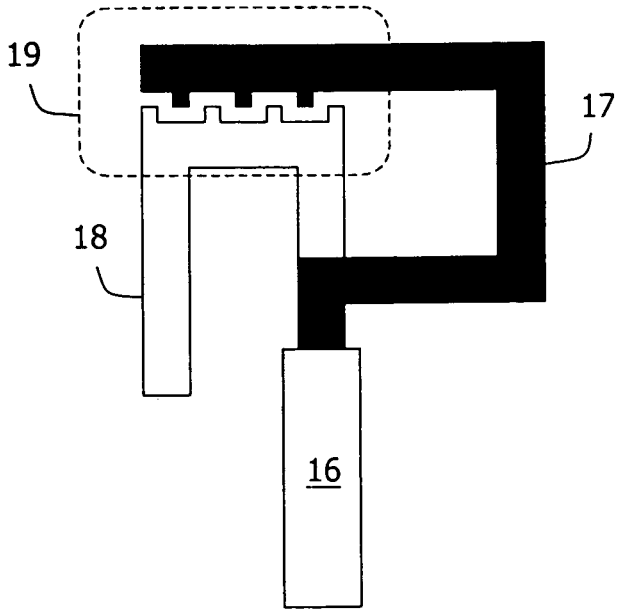
FIG. 3 to FIG. 7 respectively show schematic diagrams of several other embodiments of the present invention.

FIG. 3 shows another embodiment of the present invention. In this embodiment, a portion of the folded arm 17 and a portion of the shorted arm 18 have a teeth-like shape, to form a Meander type coupling structure 19 for enhancing the coupling effect (for better illustrating the structure, a wider gap between the teeth is drawn in the coupling structure 19 of FIG. 3, but the pitch may be denser in an actual case). By such structure which enhances the coupling effect, the total length of the shorted arm 17 can be further shortened.

Figure 4:
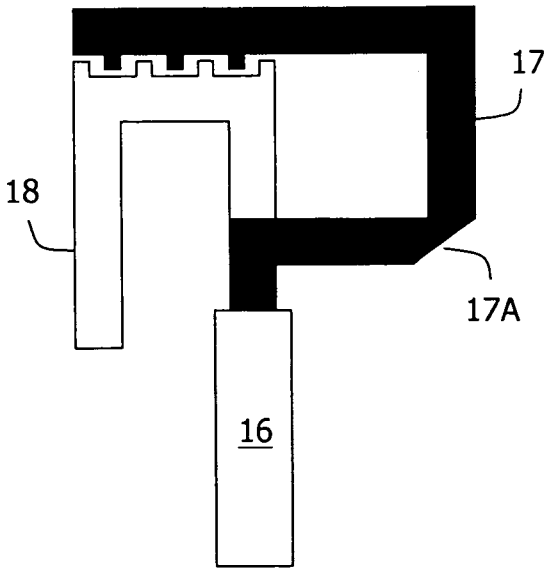

FIG. 4 shows another embodiment of the present invention. In this embodiment, the folded arm 17 has a chamfer structure 17A at the joint between the segments L1 and L2, to reduce the impact of a reflective wave caused by the turning corner. The chamfer structure 17A can be arranged at any appropriate turning corner (for example, the turning corners "b" or "c" in FIG. 1), or at a critical point between different wave lengths. In this embodiment, the joint between segments L1 and L2 is a critical point of the first wave length because the length H1+L1 determines the higher resonant frequency.

Figure 5:
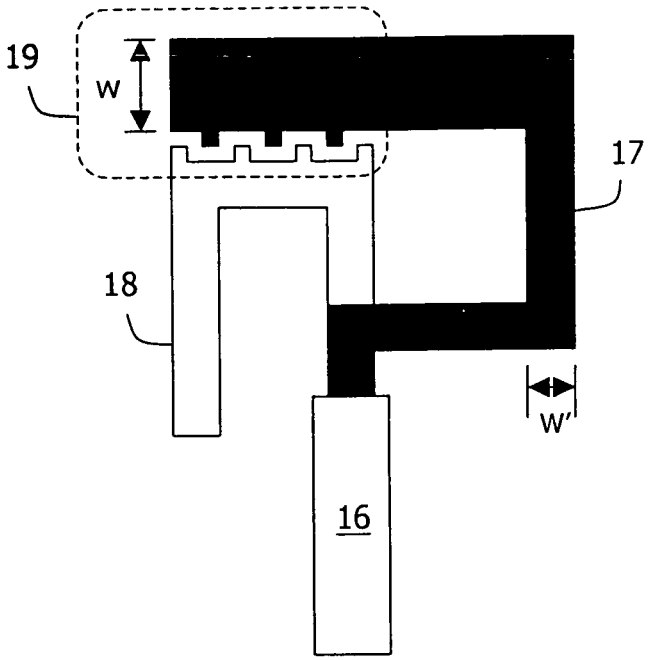

FIG. 5 shows another embodiment of the present invention. In this embodiment, the folded arm 17 has a relatively wider width w in the coupling structure 19 than the width w' of the other segments (w>w'). Since the coupling structure 19 has a relatively wider width which enhances the coupling effect, the total length of the folded arm 17 can be further shortened, such that the area of the whole antenna can be further reduced.

Figure 6:
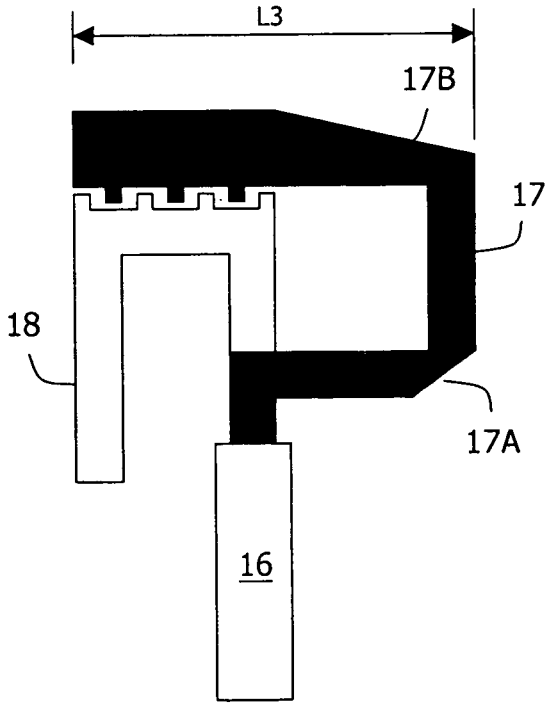

FIG. 6 shows another embodiment of the present invention. In this embodiment, other than the chamfer structure 17A, the folded arm 17 has an incremental structure 17B (that is, a portion having an increasing width) in the segment L3. This also reduces the impact of a reflective wave caused by the turning corner, to remedy the return loss of the antenna.

Figure 7:
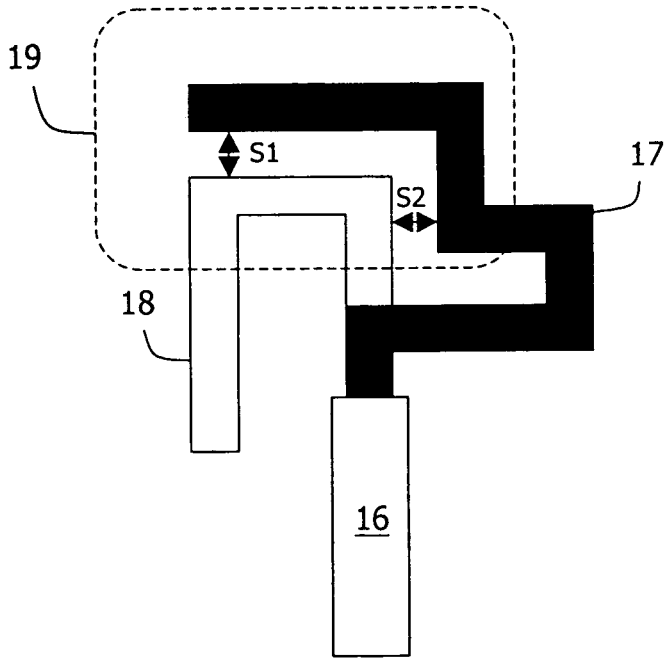
Figure 8:
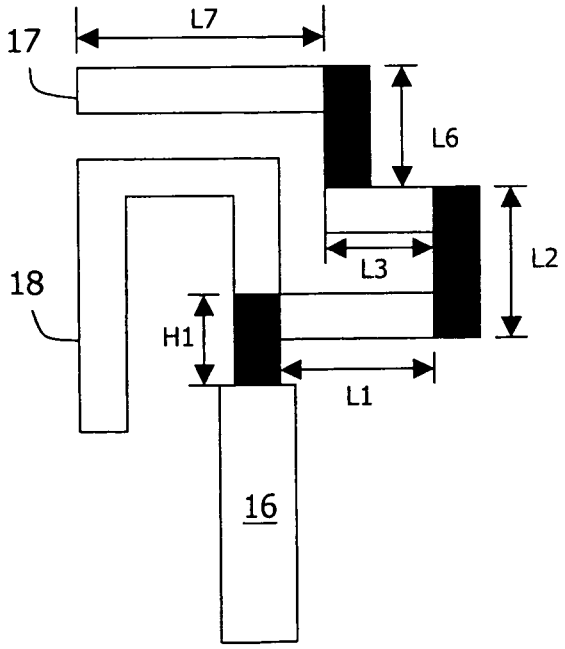
FIG. 8 shows the relationship between a folded arm and a frequency band of the embodiment of FIG. 7.

The aforementioned embodiments illustrate multi-band antenna structures with two primary frequencies. In the same spirit, various other antenna shapes to enhance the coupling effect or to increase the number of the frequency bands can be designed. For example, referring to the embodiment of FIG. 7, the folded arm 17 includes five turning corners, forming two coupling gaps S1 and S2 (longer coupling length) with the shorted arm 18, such that the coupling structure 19 provides a stronger coupling effect. Referring to FIG. 8, in this embodiment the length H1+L1 of the folded arm 17 determines the highest resonant frequency of the antenna; the total length of the folded arm 17, i.e., H1+L1+L2+L3+L6+L7, determines the lowest frequency (with compensation of the coupling effect induced by coupling gaps S1 and S2); and a middle resonant frequency is provided therebetween. In other words, the antenna of this embodiment provides three frequency bands, wherein the critical point of the first wave length is at the joint between the segments L1 and L2; the critical point of the second wave length is at the joint between the segments L3 and L6; and the critical point of the third wave length is at the end of the segment L7.

Figure 9:
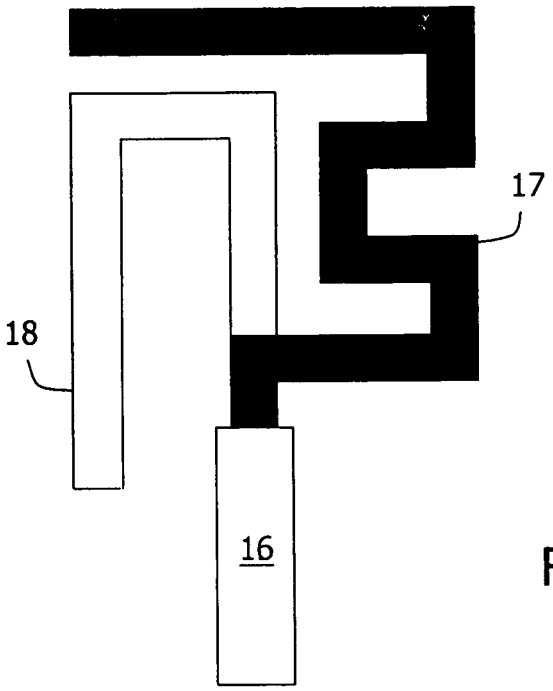
FIG. 9 shows a schematic diagram of yet another embodiment of the present invention.
Figure 10:
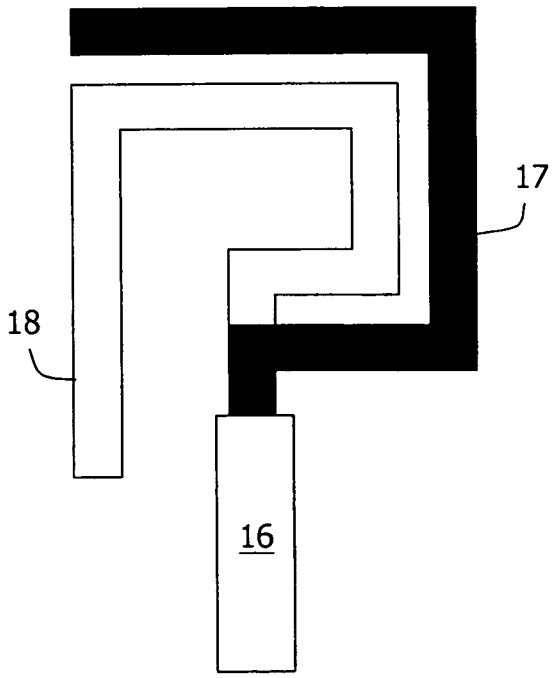
FIG. 10 shows a schematic diagram of yet another embodiment of the present invention.

Under the above teachings, those skilled in the art can make various designs under the spirit of the present invention. For example, FIG. 9 and FIG. 10 show two possible variations to reduce the area of the multi-band antenna by the arrangement of more turning corners or coupling effect. According to the present invention, the multi-band antenna can operate at two or more primary frequencies.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, the shape of the folded arm, the shorted arm, or the feeding arm is not limited to what is shown in the embodiments, but can be modified in numerous ways. In view of the foregoing, the spirit of the present invention should cover all such and other modifications and variations, which should be interpreted to fall within the scope of the following claims and their equivalents.

What is claimed is:

1. A multi-band printed antenna, comprising:

a grounding plane; and an antenna part, including a shorted arm electrically connected to the grounding plane, a folded arm connected to the shorted arm, and a feeding arm connected to the folded arm, the feeding arm being utilized for providing signals to the folded arm and the shorted arm;

wherein the folded arm comprises at least one turning corner and provides at least two resonant frequencies according to the turning corner and the total length of the folded arm, and wherein a portion of the folded arm and a portion of the shorted arm from a Meander type coupling structure.

2. The multi-band printed antenna of claim 1, wherein the coupling structure comprises at least one coupling gap.

3. The multi-band printed antenna of claim 1, wherein the coupling structure comprises a plurality of coupling gaps.

4. The multi-band printed antenna of claim 1, further comprising a connecting pin for electrically connecting the shorted arm to the grounding plane.

5. The multi-band printed antenna of claim 1, wherein the portion of the folded arm forming the coupling structure comprises a first width, and another portion of the folded arm has a second width, the first width being greater than the second width.

6. The multi-band printed antenna of claim 1, wherein the folded arm comprises a plurality of segments, wherein at least one segment of the plurality of segments comprises a portion having an increasing width.

7. A multi-band printed antenna, comprising:

a grounding plane; and an antenna part, including a shorted arm electrically connected to the grounding plane, a folded arm connected to the shorted arm, and feeding arm connected to the folded arm, the feeding arm being utilized for providing signals to the folded arm and the shorted arm;

wherein the folded arm comprises at least one turning corner and provides at least two resonant frequencies according to the turning corner and the total length of the folded arm, and wherein the folded arm comprises at least a first, a second, a third and a fourth segments, a sum of a length of the first segment and a length of the second segment corresponding to a first wavelength.

8. The multi-band printed antenna of claim 7, wherein a sum of the length of the first segment, the length of the second segment, a length of the third segment, and a length of the fourth segment corresponds to a second wavelength.

9. The multi-band printed antenna of claim 8, wherein the first wavelength is less than the second wavelength.

10. A multi-band printed antenna, comprising:

a grounding plane; and an antenna part, including a shorted arm electrically connected to the grounding plane, a folded arm connected to the shorted arm, and a feeding arm connected to the folded arm, the feeding arm being utilized for providing signals to the folded arm and the shorted arm;

wherein the folded arm comprises at least one turning corner and provides at least two resonant frequencies according to the turning corner and the total length of the folded arm, and wherein the folded arm comprises at least one chamfer structure.

* * * * *